United States Patent [19]

Peng

[11] 4,237,945

[45] Dec. 9, 1980

[54] APPARATUS AND METHOD FOR ABRADING PENCIL LEAD

[76] Inventor: Ting-Fu Peng, 6315 Fair Oaks Ave., Baltimore, Md. 21214

[21] Appl. No.: 916,230

[22] Filed: Jun. 16, 1978

[51] Int. Cl.[3] ..... B43L 23/00

[52] U.S. Cl. ..... 145/3.32; 51/181 R; 144/310 R; 206/224

[58] Field of Search ..... 51/181 R, 211 R; 144/310 R, 320; 145/3.1, 3.3, 3.31, 3.32, 3.9; 76/81.3; 206/224, 576

[56] References Cited

U.S. PATENT DOCUMENTS

| | | | |
|---|---|---|---|
| 1,688,840 | 10/1928 | Tevonian | 145/3.32 |
| 1,863,616 | 6/1932 | Bosch | 145/3.32 |
| 3,254,630 | 6/1966 | Tufan | 51/181 |
| 3,840,113 | 10/1974 | Bartleson | 206/224 |

FOREIGN PATENT DOCUMENTS

| | | | |
|---|---|---|---|
| 178837 | 6/1954 | Fed. Rep. of Germany | 145/3.32 |
| 9590 | of 1887 | United Kingdom | 51/181 |
| 21869 | of 1909 | United Kingdom | 145/3.32 |

*Primary Examiner*—Gary L. Smith

[57] ABSTRACT

An apparatus and method for abrading pencil lead are provided. The apparatus comprises two major parts—a receptacle and an abrader. The apparatus is further modified by the addition of two subordinate components—storage space and graphite dust cleaning compartments. The receptacle is in the form of a container having an open top and is defined by a bottom and two sidewalls; the abrader is in the form of a plate with abrasive surface on both sides. At one end of the abrader, two pivotal means are provided to engage with two pivotal receiving means formed at middle points of two inclining side rims of the receptacle; and the other end of the abrader rests on the end rim of the receptacle. When the graphite dust presents on the surface of the abrader after abrading, the abrader is flipped from one side to the opposite side of the rim, the graphite dust is threby disposed of in the receptacle and the other side of the dust-free abrading surface appears toward the top, ready for the next abrading.

3 Claims, 5 Drawing Figures

APPARATUS AND METHOD FOR ABRADING PENCIL LEAD

BACKGROUND OF THE INVENTION

In architectural and engineering drawings, especially for lettering purposes, there is a need to sharpen the pencil lead point in chisel or wedge shape; and the only abrader for the above purpose which we can find in the store is in the form of approximately 1"×3" size sandpapers stacked in a pack and fixed on top of an approximately 1"×5" size wood plate, the extra 2" being used as handle.

The way to remove the graphite lead dust from the sandpaper is by means of hitting the rim of the wood plate on any hard surface such as table leg, rim of trash can, etc. Consequently, the lead dust tends to scatter around the work area and smear the floor. It is also an inconvenience to move the wood plate around to dispose of the pencil lead dust, and this further causes dispersing of lead dust at work area. A novel device to eliminate these deficiencies is therefore invented.

OBJECTS OF THE INVENTION

It is a primary object of the present invention to provide a novel apparatus and method to sharpen the graphite lead in chisel or wedge shape. The apparatus comprises mainly an abrader and refuse receptacle in a simple form. The method is a one-step operation to accomplish functions of disposal of the lead dust and providing dust-free abrading surface for use at the same time.

Another object of the present invention is to provide a novel apparatus which is simple in construction, economic to manufacture, durable in performance and which achieves desirable functions as well as disposes of lead dust instantly and cleanly.

SUMMARY OF THE INVENTION

The apparatus of the present invention comprises two major parts—a receptacle and an abrader. The apparatus is further modified by the addition of two subordinate components—storage space and graphite dust cleaning compartments.

The receptacle with an open top is defined by sidewalls and a bottom. Two pivotal receiving means are formed at middle points of two opposite side rims of the receptacle in order to receive two pivotal means of the abrader. The abrader is in the form of plate with abrasive surfaces on both sides of the plate. One end of the abrader possesses two pivotal means and each pivotal means fits into each pivotal receiving means of the side rims; the other end of the abrader rests on the end rim of the receptacle. When the graphite dust presents on the surface of the abrader after the abrading, turn the pivotal means or press the pencil point against the end of the abrader to flip the abrader from one side to the opposite side of the rim and let the end of the abrader hit against the rim of the receptacle, the impact between the end of the abrader and the rim and the pull of gravity cause the lead dust to fall from the abrading surface into the receptacle; meanwhile, the other side of the dust-free abrading surface appears toward the top, ready for the next abrading.

The one-step operation by flipping the abrader from one rim to the opposite rim accomplishes two functions of disposing lead dust appearing on one surface and providing another dust-free abrading surface ready for use at the same time.

The one-step operation is repeated again and again until the graphite dust begins to fill up the receptacle and is ready for cleaning. The accumulated graphite dust contained in the receptacle is disposed of by means of turning the receptacle upside down and flipping the abrader back and forth to hit the end rims of the receptacle whereby dust falls out of the receptacle.

Storage space and graphite dust cleaning compartments are attached to the bottom of the receptacle. The storage space is mainly for storing spare sand papers and other accessories of the apparatus. The compartments are symmetrical with a divider between them; in each compartment, dust cleaning pad is provided for cleaning the dust appearing on the lead point of the pencil; and opening of each compartment is easily accessible from the side of each sidewall.

DESCRIPTION OF THE DRAWINGS

For an apparent understanding of the present invention, the following specification and drawings are referred to as follows.

In the drawings.

Figure 1:
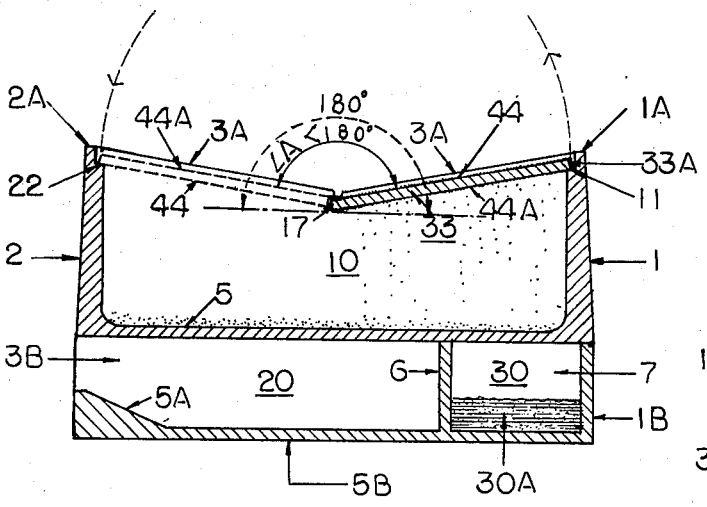
FIG. 1 is a cross section view taken along line E—E.
Figure 2:
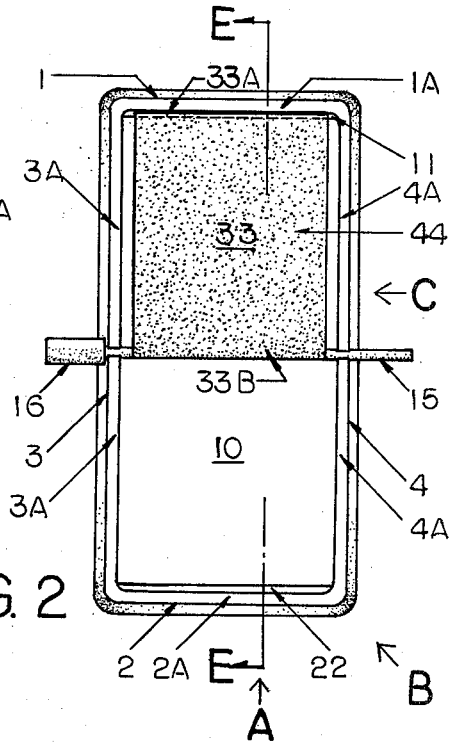
FIG. 2 is a plan view of the apparatus of the present invention.
Figure 3:
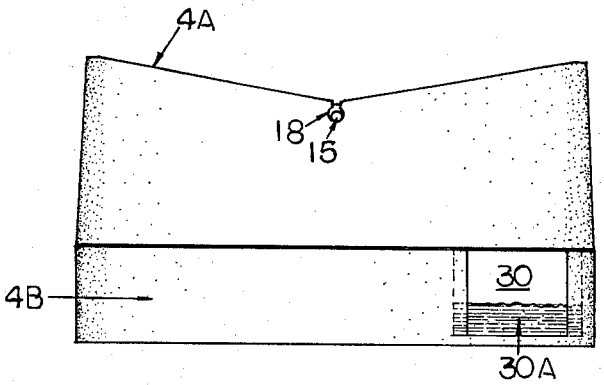
FIG. 3 is an elevation view from location C.
Figure 4:
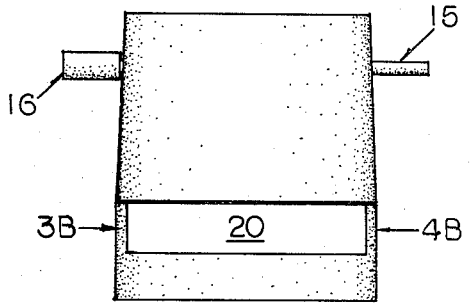
FIG. 4 is an elevation view from location A.
Figure 5:
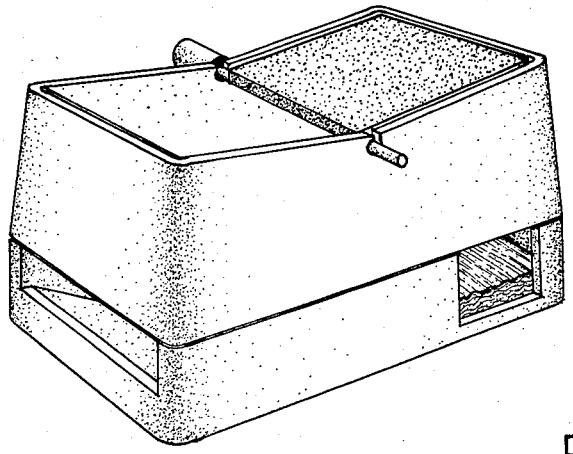
FIG. 5 is a perspective view from location B.

Referring in detail to the drawings and with particular reference to FIG. 1 and FIG. 2: Receptacle 10 with an open top is defined by sidewalls 1, 2, 3 & 4, and bottom 5. Storage space 20 is defined by said bottom 5 and bottom 5B, sidewalls 3B, 4B (see also FIG. 3 & FIG. 4) and 6, and inclining raised bottom 5A; said bottom 5, 5B, sidewalls 1B & 6 define a space, and end wall 7, which is perpendicular to and located at middle of said bottom 5B, divides the said space into two graphite dust cleaning compartments 30 & 30. Dust cleaning pad 30A is placed in each side compartment 30 for the purpose of cleaning graphite dust appearing on lead point of the pencil and is replaceable. The abrader 33 is in the form of plate with abrasive surfaces 44 & 44B on both sides and is made of any suitable material. At center points of the side rims 3A & 4A, pivotal receiving means 17 & 18 are formed in order to receive pivotal means 15 & 16 which connect with said abrader 33 at one end 33B. Said pivotal means 16 is enlarged to form a knob as an example. In order to reduce the rotation angle of the said abrader, each of said rims 3A and 4A declines from two ends toward center point to form a valley and defines an angle ∠A which is less than 180°, therefore, by turning the said pivotal means or pressing against said end 33A with pencil point to flip the said abrader 33 from said recessed end rim 11 or 22 to said recessed end rim 22 or 11, the said abrader 33, which is supported by said pivotal means 15 and 16 at said end 33B and the other said end 33A rested on said recessed rim 11 or 22, will rotate less than 180° as shown in FIG. 1.

OPERATION OF THE INVENTION

When the graphite dust presents on the surface 44 of the abrader 33 after abrading, turn the knob 16 or press pencil point against the end 33A of the said abrader 33 to flip the said abrader 33 from rim 11 toward the opposite rim 22 of the receptacle 10 and let the said end 33A hit the said rim 22, the impact between the said rim 22 and the said end 33A, and the pull of gravity cause the said dust to drop into the said receptacle 10; meanwhile, the other side of the dust-free abrading surface 44A appears toward the top, ready for the next abrading. The one step operation by flipping said abrader 33 from said rim 22 or 11 to the opposite said rim 11 or 22 accomplishes two functions of disposal of lead dust appearing on one surface 44 or 44A and providing another dust-free abrading surface 44A or 44 ready for use at the same time.

The one-step operation is repeated again and again until the graphite dust begins to fill up the said receptacle 10 and is ready for cleaning. The accumulated graphite dust contained in said receptacle 10 is disposed of by means of turning the said receptacle upside down and flipping the said abrader 33 back and forth to hit the said recessed end rims 11 and 22 whereby dust falls out of the said receptacle 10.

I claim:

1. A pencil lead abrading device, comprising two major parts—a receptacle and an abrader, and is further defined as follows:

the said receptacle with an open top is defined by sidewalls and a bottom, whereupon, two pivotal receiving means are formed at middle points of two opposite side rims of the said receptacle in order to receive two pivotal means of the said abrader, and each of the said side rims decline from two ends toward middle point of the said side rim to form a valley and to define an angle less than 180°;

the said abrader being in the form of plate with abrasive surfaces on both sides of the said plate, and possessing two pivotal means at one end of said plate, and each said pivotal means fits into each said pivotal receiving means of said side rims; the other end of the said abrader rests on the end rim of said receptcale, therefore, by turning one of the said pivotal means or pressing against the said end of the said abrader with pencil point to flip the said abrader, the said abrader will rotate from said end rim to the other end rim of the said receptacle.

2. A pencil lead abrading device as described and defined in claim 1, wherein two subordinate components—storage space and graphite dust cleaning compartments, are provided and is further defined as follows:

the said storage space with an open side is attached to said bottom of said receptacle and is defined by said bottom of said receptacle, sidewalls, an end wall, a bottom of which the end portion raises up toward said open side to form an inclining raised bottom;

the said graphite dust cleaning compartments with an open side for each said compartment are attached to said bottom of said receptacle and are defined by said bottom of said receptacle, sidewalls, a bottom and a common end wall; a dust cleaning pad is placed in each said compartment.

3. A method of operating a pencil lead abrading device defined in claim 1 or claim 2, comprising the steps of:

When graphite dust presents on the surface of the said abrader after abrading, turning the said pivotal means or pressing pencil point against the end of said abrader to flip the said abrader from the said rim toward the opposite said rim of the said receptacle and letting the said end hit the said opposite rim to cause said dust to drop into the said receptacle, repeating the above operation by flipping said abrader back and forth until the graphite dust begins to fill up the said receptacle and is ready for cleaning.

disposing of the accumulated graphite dust contained in said receptacle is by means of turning the said receptacle upside down and flipping said abrader back and forth to hit said end rims whereby dust falls out of the said receptacle.

* * * * *